US005314000A

United States Patent [19]

Wang et al.

[11] Patent Number: 5,314,000

[45] Date of Patent: May 24, 1994

[54] METHOD OF CONTROLLING GRAIN SIZE DISTRIBUTION IN INVESTMENT CASTING

[75] Inventors: Hsin-Pang Wang, Rexford; Erin M. Perry, Scotia, both of N.Y.

[73] Assignee: General Electric Company, Schenectady, N.Y.

[21] Appl. No.: 56,273

[22] Filed: May 3, 1993

[51] Int. Cl.[5] ..... B22D 27/20

[52] U.S. Cl. ..... 164/4.1; 164/55.1

[58] Field of Search ..... 164/55.1, 57.1, 58.1, 164/4.1, 517, 150

[56] References Cited

U.S. PATENT DOCUMENTS

| | | | |
|---|---|---|---|
| 3,158,912 | 12/1964 | Schweikert | 164/517 |
| 4,004,630 | 1/1977 | Dunks | 164/57.1 |
| 4,667,725 | 5/1987 | Bäckerud | 164/4.1 |
| 4,806,157 | 2/1989 | Subramanian | 164/57.1 |

FOREIGN PATENT DOCUMENTS

| | | | |
|---|---|---|---|
| 1282247 | 11/1968 | Fed. Rep. of Germany | 164/4.1 |
| 9206809 | 4/1992 | World Int. Prop. O. | 164/4.1 |
| 9206810 | 4/1992 | World Int. Prop. O. | 164/4.1 |

OTHER PUBLICATIONS

"The Use of Gas-Generating Mold Coatings for the Grain Refinement of Aluminum," Metallurgical Trans. B, vol. 10B, pp. 203-210, Jun. 1979.

*Primary Examiner*—Paula A. Bradley
*Assistant Examiner*—Erik R. Puknys
*Attorney, Agent, or Firm*—Paul R. Webb, II

[57] ABSTRACT

This invention relates to a method for controlling the grain size distribution in cast parts made from nickel-based superalloys. Such methods of this type, generally, employ the use of different inoculant concentration levels to balance the differences in cooling rates that occur at different regions of the cast part in order to achieve the desired microstructure of the cast part.

5 Claims, 1 Drawing Sheet

METHOD OF CONTROLLING GRAIN SIZE DISTRIBUTION IN INVESTMENT CASTING

BACKGROUND OF THE INVENTION

1. Field of the Invention

This invention relates to a method for controlling the grain size distribution in cast parts made from nickel-based superalloys. Such methods of this type, generally, employ the use of different inoculant concentration levels to balance the differences in cooling rates that occur at different regions of the cast part in order to achieve the desired microstructure of the cast part.

2. Description of the Related Art

It is known, in investment casting (commonly known as, lost wax casting) to employ homogeneous or heterogeneous nucleation techniques. In particular, with respect to the homogeneous nucleation technique, the alloy begins to nucleate even when there is no external solid phase present. However, this homogeneous technique is very difficult to achieve due to the surface tension of the liquid metal. The surface tension of the liquid metal typically does not allow for the nucleation to occur. Consequently, the heterogeneous nucleation technique is the preferred technique.

In this heterogeneous technique, the nickel-based superalloys generally require the usage of an external solid phase, known as grain refiners, to help increase the number of nucleation sites, thereby resulting in a more finely-grained microstructure. In the terminology of the casting industry, these grain refiners are called "inoculants". The inoculation process is implemented by mixing the inoculant into the ceramic slurry used to form the first layer of the ceramic mold. A second technique for implementing the inoculation process is to add a coating on the inner surface of the ceramic mold, where the coating layer consists of a mixture of inoculant and binder. Typically, the binder is any suitable binder.

The grain size of the microstructure varies significantly from thin sections to thick ones in production cast parts. FIG. 1 shows a section of an investment cast engine component, which exhibits a large variation in thickness and grain size throughout the part. Generally such an investment cast engine component is cast using the heterogeneous nucleation technique. This technique consists of subjecting the component to an equal concentration of inoculant on all of the mold surfaces. However, while an equal concentration of inoculant is ideal for a constant thickness part, the complex design of the engine component adversely affects the grain size distribution of the alloy. In particular, the thinner sections tend to have finer grain size while the thicker sections usually include larger grain sizes. These variations in grain size adversely affect the mechanical properties of the component. Therefore, a more advantageous method, then, would be presented if such variations in grain size could be controlled.

It is apparent from the above that there exists a need in the art for a method which is capable of creating nucleation sites, and which at least equals the nucleation site creation characteristics of known nucleation techniques, particularly those of the highly advantageous heterogeneous nucleation technique, but which at the same time is capable of controlling the grain size. It is a purpose of this invention to fulfill this and other needs in the art in a manner more apparent to the skilled artisan once given the following disclosure.

SUMMARY OF THE INVENTION

Generally speaking, this invention fulfills these needs by providing a method for controlling grain size distribution of an actual casting made from a liquid metal including an inoculant, comprising the steps of: coating a first and second cross-section of a sample mold with a predetermined concentration of said inoculant, casting said first and second cross-sections with said liquid metal in said sample mold to create a sample casting; determining a grain size distribution of said first and second cross-sections of said sample casting; repeating said coating and said casting steps for at least two different inoculant concentrations; determining an inoculant concentration from said grain size distribution to be applied to an actual casting which has first and second cross-sections that are substantially the same in cross-sectional dimensions to said first and second cross-sections of said sample casting such that said grain size distribution of said actual casting is substantially controlled; pouring said liquid metal into said actual casting, and cooling said liquid metal in said actual casting.

In certain preferred embodiments, the different inoculant concentration levels are used to balance the differences in cooling rate that occur at different regions of the casting in order to achieve the desired microstructure.

The preferred grain size distribution controlling method, according to this invention offers the following advantages: excellent grain size distribution control; excellent economy; good stability; good durability; and high strength for safety. In fact, in many of the preferred embodiments, these factors of grain size distribution and economy are optimized to an extent that is considerably higher than heretofore achieved in prior, known grain size distribution techniques.

BRIEF DESCRIPTION OF THE DRAWINGS

The above and other features of the present invention which will be more apparent as the description proceeds are best understood by considering the following detailed description in conjunction with the accompanying drawings wherein like character represent like parts throughout the several views and in which.

DETAILED DESCRIPTION OF THE INVENTION

Figure 1:
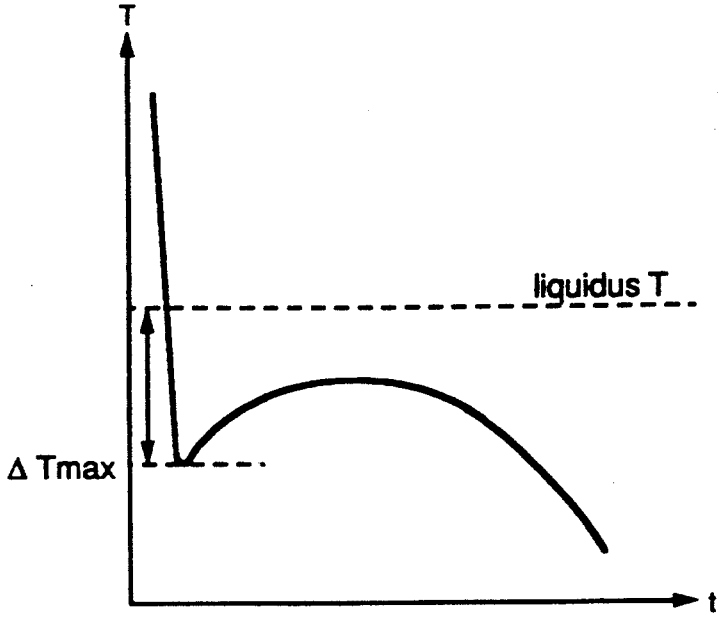
FIG. 1 is a graphical illustration of a cooling curve for a typical alloy with temperature plotted against time.

Based on the nucleation theory for equiaxed solidification, the nucleation rate is a strong function of the local thermal history, or, to be more precise, the local undercooling ($\Delta T$). FIG. 1 is a graphical illustration of a cooling curve for a typical superalloy. The material cools to a temperature below the liquidus temperature as the nucleation process begins. At some point, the heat release rate from all the nucleation sites becomes larger than the cooling rate from the environment, and the temperature rises slightly from a local minimum. This stage is termed recalescence. Undercooling is defined as the temperature drop in the molten metal to below the liquidus temperature. The maximum undercooling ($\Delta T_{max}$) is defined as the temperature difference between the liquidus temperature and the temperature on the cooling curve just before recalescence occurs. This maximum undercooling has been indicated in FIG. 1. The nucleation rate is typically proportional to the square of the maximum undercooling temperature. In general, a faster cooling rate gives a larger maximum undercooling and a greater number of nucleation sites, thus producing a finer-grained part.

This undercooling phenomena only occurs in the initial transient period in which the heat transfer mechanism is mainly the thermal contact heat transfer between the superheated melt and the preheated mold. Therefore, given the same inoculation condition and a uniform ceramic mold thickness, thin sections of the part will have a faster cooling rate than thick sections, resulting in a finer grain structure in those thinner sections.

Changing the process conditions, i.e., the superheat temperature of the melt and/or the preheat temperature of the ceramic mold, will only affect the overall average grain size. The technique of wrapping insulation material around the outer surface of the mold can only alter the long term thermal behavior, not the initial transient, because of the slow thermal propagation inside the ceramic mold. The grain size has already been determined by the time the thermal front reaches the mold surface. The proper selection of gating locations will ensure complete filling of the mold without coldshuts and also ensure that the feeding path remains open during solidification without shrinkage voids. However, this gating procedure cannot be used to tailor the grain size distribution.

In the present invention, the inoculant can be added to the melt in the following way: an inoculant/binder mixture of some specified inoculant concentration is coated onto different locations on the wax pattern of the part to be made. The binder material is, typically, colloidal silica. Once the coating is in place, the wax pattern is dipped into a ceramic slurry several times to build up the ceramic mold. When the mold has dried, the wax pattern is melted out, leaving behind a mold with a layer of inoculant on its inner surfaces. The mold is then heated for ½ hour at 200° C. to eliminate any moisture in the inoculant/binder layer. Finally, the mold is heated for ½ hour at 800° C. in order to provide good high temperature bond strength between the mold and the inoculant/binder layer.

Figure 2:
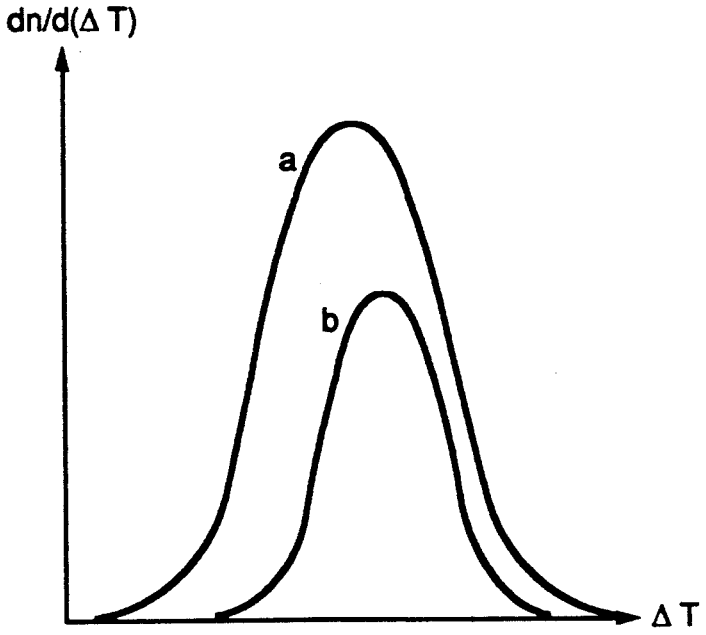
FIG. 2 is a graphical illustration of nucleation distribution curves for two different inoculant concentration levels with the derivative of the number of nucleation sites with respect to undercooling, $\Delta T$, plotted against the variations in undercooling.

As the level of inoculant concentration changes, the nucleation parameters are also changed. FIG. 2 is a graphical illustration of the nucleation distribution curves for two different inoculant concentration levels. The horizontal axis indicates variations in the undercooling ($\Delta T$), and the vertical axis indicates the derivative of the number of nucleation sites with respect to $\Delta T$. The area under the curve is the actual number of nucleation sites. Curve "a" in FIG. 2 would have a higher inoculant concentration level than curve "b". The area under curve "a" will always exceed the area under curve "b". Therefore, a higher level of inoculant concentration results in more nucleation sites, thereby producing a finer-grained structure. If the inoculant concentration used on different regions of the wax pattern is varied, then the resulting grain size distribution within the part can be controlled.

However, since the local cooling curves are not known beforehand, a selection of the proper inoculant concentration levels for the different regions becomes a difficult task. There are two ways of determining the proper concentration level in order to implement the present invention of varying the distribution of inoculant for microstructure control, namely, casting trials and a micro-macro modeling approach.

With respect to the casting trial approach, this approach is an iterative approach using experimental trial runs. The first trial run uses one inoculant concentration for the entire part. Examination of the grain size distribution in the resultant cast part provides direction on whether to increase or decrease the concentration level at different regions for the next run. The needed concentration level can be obtained by adjusting the weight ratio between the inoculant and binder during mixing. After a few runs, the desired grain size distribution can be achieved. This is a traditional trail-and-error approach that might sometimes prove to be costly and time consuming.

With respect to the micro-macro modeling approach, this approach uses a micro-macro process model to help make decisions on the levels of inoculant needed, as well as, the exact locations where the inoculant should be placed. This approach is extremely powerful in dealing with complicated geometries, such as engine components, and the number of casting trial runs can be significantly reduced. There are two phases for implementing this micro-macro modeling approach.

First, the coefficients of the nucleation model must be determined empirically for a given superalloy by conducting a series of melting/solidification experiments in the laboratory, using crucibles of different sizes to produce different cooling rates. The correlations between these empirical coefficients for the nucleation model and the different levels of inoculant concentration will be generated.

The inoculant/binder mixtures will be uniformly coated on the inner surface of the crucibles. The coated crucibles, with the sample alloy material inside them, will be heated to the superheat temperature and then cooled down to room temperature in a conventional vacuum furnace. The cooling curves will be recorded by conventional thermocouples in each crucible, and analyzed by conventional analyzing techniques to generate the correlations between the nucleation rate and the undercooling for the given inoculant concentration. Then, the experiment will be repeated with different levels of inoculant concentration, achieved by changing the weight ratio between the inoculant and the binder.

Second, the nucleation models for different levels of inoculation, as well as models for the growth kinetics of the superalloy, will be incorporated into a micro-macro finite element model which predicts the temperature and grain size distribution. From that point on, all experiments will be conducted on a conventional computer to evaluate the sensitivity of the grain size to the inoculant levels at the different locations in the part, in order to achieve the optimum grain structure. For example, the inoculant level in the coating could be low at the thin sections and high at the thick sections for a more balanced grain size distribution.

Process design iterations on the computer are much more cost effective than the actual trial runs. The key innovative concept is really twofold: the use of the different inoculant concentration levels to control the grain size distribution; and the use of micro-macro modeling to help determine the correct locations for placing the inoculant, as well as, the inoculant concentrations.

Once given the above disclosure, many other features, modification or improvements will become apparent to the skilled artisan. Such features, modifications or improvements are, therefore, considered to be a part of this invention, the scope of which is to be determined by the following claims.

What is claimed is:

1. A method for controlling grain size distribution of an actual cast part made from a liquid metal including an inoculant wherein said method comprises the steps of:

a) coating a first and a second location on the inner surface of a sample mold with a predetermined concentration of said inoculant, said first and second locations corresponding to first and second regions of different thicknesses on a sample part to be cast in said sample mold;

b) casting said sample part in said sample mold from said liquid metal;

c) determining a grain size distribution of said first and second regions of said sample cast part;

d) repeating steps a) through c) using a mold generally identical to said sample mold for at least one other inoculant concentration;

e) determining an inoculant concentration for said first region and a different inoculant concentration for said second region from said grain size distribution of said sample parts determined from step c) such that said grain size distribution of corresponding first and second regions of an actual cast part is controlled;

f) repeating steps a) and b) using an actual mold generally identical to said sample mold for an inoculant concentration for said first location and a different inoculant concentration for said second location equal, respectively, to the inoculant concentrations of said first and second regions determined from step e) to make said actual cast part such that said grain size distribution of said actual cast part is controlled.

2. A method for controlling grain size distribution of an actual cast part made from a liquid metal including an inoculant, said actual cast part having a first region with a first thickness and a second region with a different second thickness, and wherein said method comprises the steps of:

a) determining cooling rates for a plurality of sample crucible castings with a predetermined concentration of said inoculant, each of said sample crucible castings having a size which is different from that of the other said sample crucible castings;

b) repeating step a) for at least one other inoculant concentration;

c) analyzing said cooling rates to determine coefficients of nucleation of said different size sample crucible castings;

d) determining from said coefficients an inoculant concentration to be applied to said first region and a different inoculant concentration to be applied to said second region of said actual part to be cast based on the thicknesses of said regions such that said grain size distribution of said actual part to be cast is controlled; and e) casting said actual part for the inoculant concentration for said first region and the different inoculant concentration for said second region determined from step d) to make said actual cast part such that said grain size distribution of said actual cast part is controlled.

3. The method of claim 2, wherein said step of determining cooling rates further comprises the steps of:

a) applying a uniform coating of said inoculant to the inner surface of a first crucible for making a first crucible casting having a first size;

b) applying a uniform coating of said inoculant to the inner surface of a second crucible for making a second crucible casting having a different second size;

c) inserting a solidified metal into said first and second crucibles;

d) heating said crucibles such that said solidified metal becomes generally liquified;

e) cooling said liquid metal; and f) measuring the cooling rate of said liquid metal in said first and second crucibles.

4. The method of claim 3, wherein said first size of said first crucible casting is generally equivalent to the thickness of said first region of said actual cast part.

5. The method of claim 4, wherein said second size of said second crucible casting is generally equivalent to the thickness of said second region of said actual cast part.

* * * * *